United States Patent [19]

Rechberg

[11] Patent Number: 4,872,734

[45] Date of Patent: Oct. 10, 1989

[54] DRAWER SLIDES WITH SELF-ACTUATING LATCHING SYSTEMS

[76] Inventor: Robert Rechberg, 3800 E. Miraloma Ave., Anaheim, Calif. 92806

[21] Appl. No.: 203,233

[22] Filed: Jun. 6, 1988

Related U.S. Application Data

[63] Continuation-in-part of Ser. No. 64,407, Jun. 22, 1987, Pat. No. 4,749,242.

[51] Int. Cl.[4] ..... A47B 88/10; F16C 21/00

[52] U.S. Cl. ..... 312/333; 312/348; 384/19

[58] Field of Search ..... 312/333, 337, 348; 384/19

[56] References Cited

U.S. PATENT DOCUMENTS

| | | | |
|---|---|---|---|
| 1,557,765 | 10/1925 | Nicholas | 312/348 |
| 1,910,208 | 5/1933 | Gronberg et al. | 312/337 |
| 2,547,513 | 4/1951 | Wikman | 312/218 |
| 2,687,924 | 8/1954 | Gomersall | 384/19 |
| 2,692,802 | 10/1954 | Kurtzon et al. | 384/19 |
| 2,896,295 | 3/1957 | Fischer . | |
| 3,259,447 | 7/1966 | Deutsch | 312/348 |
| 3,401,998 | 9/1968 | Evans et al. | 312/218 |
| 3,574,437 | 4/1971 | Stein | 384/19 |
| 3,801,166 | 4/1974 | York | 312/348 |
| 3,937,531 | 2/1976 | Hagen et al. | 312/348 |
| 4,067,632 | 1/1978 | Sekerich | 312/348 |
| 4,121,876 | 10/1978 | Ratti | 384/19 |
| 4,333,690 | 6/1982 | Keefe et al. . | |
| 4,423,914 | 1/1984 | Vanderley | 312/348 |
| 4,441,772 | 4/1984 | Fielding et al. | 312/348 |
| 4,469,384 | 9/1984 | Fler et al. | 312/334 |
| 4,564,247 | 1/1986 | Knoop | 384/19 |

*Primary Examiner*—Victor N. Sakran

*Attorney, Agent, or Firm*—Stetina and Brunda

[57] ABSTRACT

Disclosed are two drawer slide assemblies incorporating first and second latching systems, respectivley. The first latching system comprises first and second latching mechanisms disposed upon three telescopically slidable members. The second latching system comprises first and third latching mechanisms disposed upon three telescopically slidable members and an additional fourth latching mechanism when an optional additional (fourth) slide member is added. A drawer slide roller device is also disclosed. Such drawer slide roller device may be disposed upon one telescopically slidable drawer slide member to facilitate smooth and quiet slidable movement thereof within an adjacent slide member.

29 Claims, 3 Drawing Sheets

Fig 4
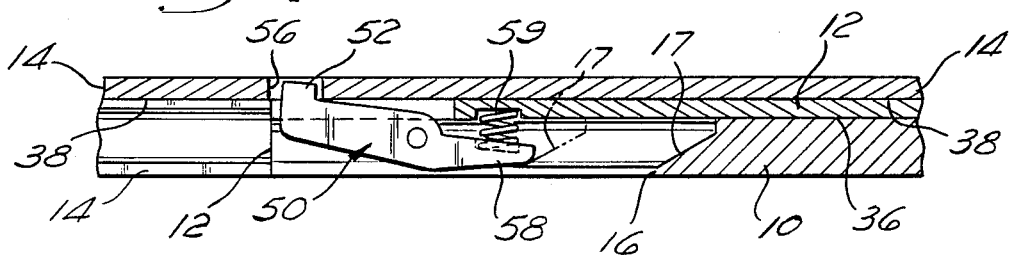
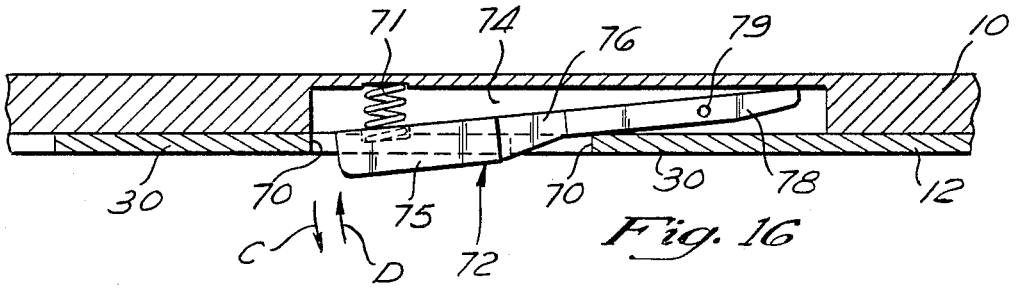
Fig. 16
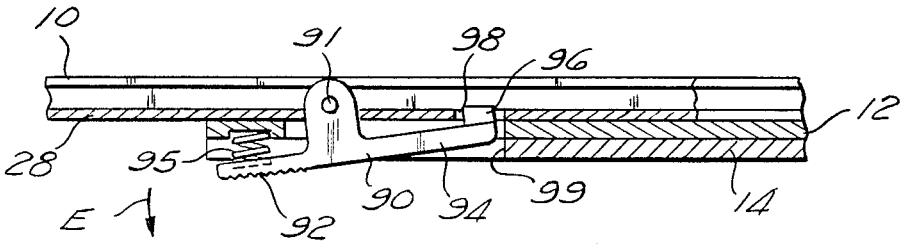
Fig. 10

10
12
14
16
18
20
22
24
26
28
30
32
36
50
56
58
90
91
92
94
96
99
100
102
104
106
108
110
10A
E

DRAWER SLIDES WITH SELF-ACTUATING LATCHING SYSTEMS

RELATED INVENTIONS

This subject application is a continuation-in-part of patent application Ser. No. 064,407, filed on June 22, 1987, entitled DRAWER SLIDE, which application has issued as U.S. Pat. No. 4,749,242 on June 7, 1988.

INCORPORATION BY REFERENCE

The entire disclosure of U.S. Pat. No. 4,749,242, issued on June 7, 1988, is incorporated herein by reference.

BACKGROUND OF THE INVENTION

A number of multi-sectional drawer slides are known in the prior art. Typically, such drawer slides are positioned on either side of a drawer so as to support and guide the drawer as it is opened and closed.

One type of prior art drawer slide, described in U.S. patent application Ser. No. 064,407, consists of a plurality of individual slide members longitudinally disposed within one another so as to be telescopically extensible when the drawer is pulled open, and slidably compressible as the drawer is pushed closed.

Various latches, catches, and stops have heretofor been incorporated into telescoping drawer slide members for the purpose of prelimiting and/or controlling the degree of extension/compression which the slide members may undergo. Specifically, in many applications, it is desirable to incorporate latching systems within the drawer slide to hold the drawer in its fully opened position until such time as the user chooses to disengage the latching system, thereby permitting the drawer to return to its closed position. Such latching systems are particularly useful in drawers and cabinetry which are mounted within moving vehicles, such as airplanes, boats, and the like.

Because no single latching mechanism or system is universally optimal for all drawer slide applications, there remains a need in the art for additional latching mechanisms and systems which may be incorporated into drawer slide assemblies to hold a drawer in its fully open position until such time as the user wishes to return the drawer to its closed position. Ideally, such latching systems should be easily engageable/disengageable by the user, preferably requiring only one hand for engagement/disengagement.

Also, because drawer slide assemblies must typically withstand many years of repetitive opening and closing, there remains a need in the art for improved drawer slide assemblies, and components thereof, which will continue to operate smoothly over extended periods of use. Accordingly, the present invention also provides an improved drawer slide assembly which incorporates a slide member roller device. The slide member roller device is preferably adapted to facilitate smooth and noise-free movement of one telescoping drawer slide member relative to an adjacent drawer slide member and to minimize wear thereon resulting from repetitive use.

SUMMARY OF THE INVENTION

The present invention provides two separate latching systems, each of which is operative to automatically lock a telescoping drawer slide assembly in a fully extended "open" configuration and to hold the slide assembly in such extended configuration until the operator volitionally disengages the latching system, thereby permitting the drawer to be returned to its closed position.

In addition, the present invention provides an improved drawer slide roller device which may be mounted at one or more points on one drawer slide member so as to promote smooth, low-friction, noise-free movement of the slide member as it articulates with or slides within an adjacent slide member.

i. First Latching System

The first latching system of the present invention is intended for use on drawer slides which comprise at least first, second, and third telescopically disposed longitudinal slide members, each of which is slidably disposed within a longitudinal receiving channel of the next slide member. This first latching system incorporates "first" and "second" latching mechanisms as described herein.

In the first latching mechanism, a first latching member is pivotally mounted at the proximal end of the second slide member. The body of the first latching member includes a pawl-like head which extends over the proximal end of the second slide member. A first aperture is formed in the third slide member such that, when the pawl-like head of the first latching member slides into alignment with the first aperture of the third slide member, the pawl-like head will snap into the first aperture thereby locking the second slide member in its optimally extended position with respect to the third slide member.

The body of the first locking member is further formed to cooperate with the proximal end of the first slide member such that, when the first slide member is advanced into the second slide member, it will come in contact with the rear portion of the first locking member body. Such direct contact between the member and the body of the first latch member will evoke a pivotal shift of the first latch member, thereby causing the pawl-like head of the latch member to be retracted out of the first aperture. Such retraction of the pawl-like head will effectively release the second slide member, allowing it to be once again slidably advanced into the receiving channel of the third slide member.

In the second latching mechanism, a second latching member is mounted near the proximal end of the first slide member. Such second latching member is pivotally connected and wholly disposable within an indentation or housing notch formed within the body of the first slide member. When fully disposed within such indentation or housing notch, the entire second latch member will be flush with or recessed within the major surfaces of the first slide member. However, a portion of the first latch member body, i.e. "the engagement portion, will be outwardly spring biased so as to be continually urged to extend outwardly beyond one of the lateral surfaces of the first slide member. Additionally, the second latching member is inwardly tapered or angled toward its pivotal connection within the housing notch.

A second aperture is formed within a lateral wall of the second slide member and when the second latching member of the first slide member comes into alignment with the second aperture of the second slide member, a portion of the second latching member will snap outwardly into the second aperture, thereby frictionally engaging and preventing further movement of the first slide member with respect to the second slide member.

Thereafter, simple finger pressure applied to the spring-biased engagement portion of the second latching member will cause the second latching member to be once again depressed within its indentation or housing notch so as to release the first slide member from the second slide member, thereby permitting the user to then advance the first slide member further into the second slide member or to fully extract the first slide member (and any attached drawer) distally out of the longitudinal receiving channel of the second slide member, as desired.

As described above, proximal advancement of the first slide member into the second slide member will result in direct contact between the advancing proximal end of the first slide member and the distal end of the first latching member body. The proximal end of the first slide member will cam against the body of the first latching member causing it to pivot slightly, thereby retracting its pawl-like head from the first aperture so as to permit subsequent proximal advancement of the second slide member within the third slide member.

ii. Second Latching System

The second latching system of the present invention is similar to the above-described first latching system in that it is designed for use on drawer slides having at least first, second, and third longitudinal slide members. Also, the second latching system may be incorporated into drawer slide assemblies having an additional (fourth) slide member. Such forth slide member will generally be employed only as a means of connecting-/disconnecting the drawer from the three main slide members and will not normally undergo slidable movement as the drawer is opened and closed.

The first and second latching systems of the present invention share common ground insofar as they both incorporate the above-described "first latching mechanism". However, the second latching system differs from the above-described first latching system in that a "third latching mechanism" replaces the above-described "second latching mechanism". Also, a "fourth" latching mechanism is incorporated when the optional additional drawer mounting slide member is included.

Accordingly, in the second latching system of the present invention, a third latching member is pivotally mounted near the distal end of the second slide member. A tongue-like projection is formed on the underside of the third latching member and is continually urged by a biasing spring through an underlying passage or aperture within the second slide member. A corresponding notch is formed on the flat outer surface of the first slide member such that, when the tongue-like projection slides into alignment with the corresponding notch, the tongue-like projection will snap into the corresponding notch so as to frictionally engage the first slide. By such arrangement, the third latching member, in cooperation with the corresponding receiving notch, will serve to hold the first slide member in its optimally extended position relative to the second slide member.

The body of the third latching member is preferably configured to incorporate a textured finger compression pad. When pressure is applied in the region of such finger compression pad, the spring bias of the third latching member will be overcome, thereby pivotally retracting the tongue-like projection from the corresponding notch and permitting the first slide member to be once again slidably moved within the longitudinal channel of the second slide member.

An additional slide member may be inserted into a longitudinal receiving track formed within the first slide member. Such additional slide member will not normally slide in and out as the drawer is opened and closed. Instead, such additional slide member will function only as an attachment/detachment means whereby a drawer may be connected to the attendant drawer slide assembly.

Such additional slide member is provided with a "fourth" latching member to releasably hold the additional slide member within the first slide member. Such fourth latching member is positioned within a recessed notch near the proximal end of the additional slide member. The outer surface of the fourth latching member is angled such that the distal-most portion thereof is generally raised above the surface of the additional slide member while the proximal end thereof slopes into the recessed notch within which the fourth latching member is positioned. Additionally, the body of the fourth latching member is spring mounted so as to be fully compressible into the confines of the recessed notch. When so compressed, the entire body of the fourth latching member is flush with or recessed below the outer surfaces of the additional slide member.

Because of the angular configuration the additional side member may be fed directly into the receiving track of the first slide member without requiring manual depression thereof—i.e. the wall of the receiving track will serve to depress the fourth member.

A corresponding fourth aperture is formed in an outer wall of the first slide member such that, when the spring-loaded fourth latching member is slidably advanced into alignment therewith the spring-biased latching member will snap outwardly into the fourth aperture thereby engaging the aperture and locking the additional slide member (and the attached drawer) in position relative to the first slide member. Subsequently, if it is wished to disconnect or remove the drawer, the fourth latching member may again be compressed by finger pressure and the additional slide member, thereafter, removed.

iii. The Drawer Slide Roller Device

In addition to the first and second slide member latching systems described above the present invention also provides a drawer slide roller device. Such roller device comprises one or more wheel-like rollers positioned at points on the outer surface(s) of one slide member so as to facilitate slidable movement thereof and decrease frictional wear as the slide member is repeatedly slidably moved within the longitudinal receiving channel of the adjacent slide member.

The individual wheel-like rollers may be positioned at any points where surface-to-surface articulation occurs between one slide member and another.

Preferably, the body of each wheel-like roller will be formed of a strong, self-lubricating substance. In particular, an aluminum-bronze alloy materials may be used. Such aluminum-bronze alloy materials are generally sufficiently strong to resist cracking or breakage of the roller body. In addition, such aluminum-bronze alloys will be substantially self-lubricating, thereby eliminating the cumbersome task of applying lubrication to the rollers within the drawer slide assembly.

In drawer slide assemblies wherein one individual slide member is disposed within an elongate receiving channel of an adjacent slide member, the rollers of the drawer slide roller device may be mounted along the top and bottom edges of the internal slide member so as to directly engage and roll against the upper and lower edges of the elongate receiving channel. Preferably, each roller will be recessed partially into a notch formed within the body of the slide member. A pivot pin will be passed through the hub of each roller and firmly anchored in either side of the slide member. Such arrangement will permit the roller to spin freely. Also, in order to minimize splaying or deformation of the surrounding metal and resultant loosening of the pivot pin during use, the area of the slide member into which the pivot pin is passed may be burnished prior to or following insertion of the pin.

A principal of the object of the invention is to provide telescoping drawer slides which incorporate two separately and/or simultaneously employable drawer slide latching systems. Such latching systems are intended to prevent the individual members of the telescoping drawer slide assembly from becoming hyperextended/disconnected as the drawer is withdrawn. Such latching systems are further intended to lock the drawer slide assembly in its fully extended configuration and to maintain such configuration until such time as the user wishes to disengage the latching mechanism to permit closure of the drawer.

Another object of the invention is to provide two automatically self-latching drawer slides which are particularly suitable for use in aircraft, on board ships, and in other moving vehicles wherein sudden changes in attitude and/or unexpected movement may cause inadvertent full or partial closure of a previously opened drawer.

A further object of the invention is to provide a self-locking, multi-member drawer slide wherein the user need depress only a single member to directly or indirectly cause the release of all corresponding locking mechanisms within the drawer slide, thereby permitting the drawer to be pushed fully closed.

Further objects and advantages of the invention will become apparent to those skilled in the art upon reading and understanding of the following detailed description and the accompanying drawings.

BRIEF DESCRIPTION OF THE DRAWINGS

FIG. 4 is a cross-sectional view of the preferred first latching of the present invention;

FIG. 6 is a cross-sectional view of the preferred second latching merchant of the present invention;

FIG. 10 is a cross-sectional view showing the preferred third latching mechanism of the present invention.

DETAILED DESCRIPTION OF THE PREFERRED EMBODIMENTS

Figures 1, 2, 3, 5:
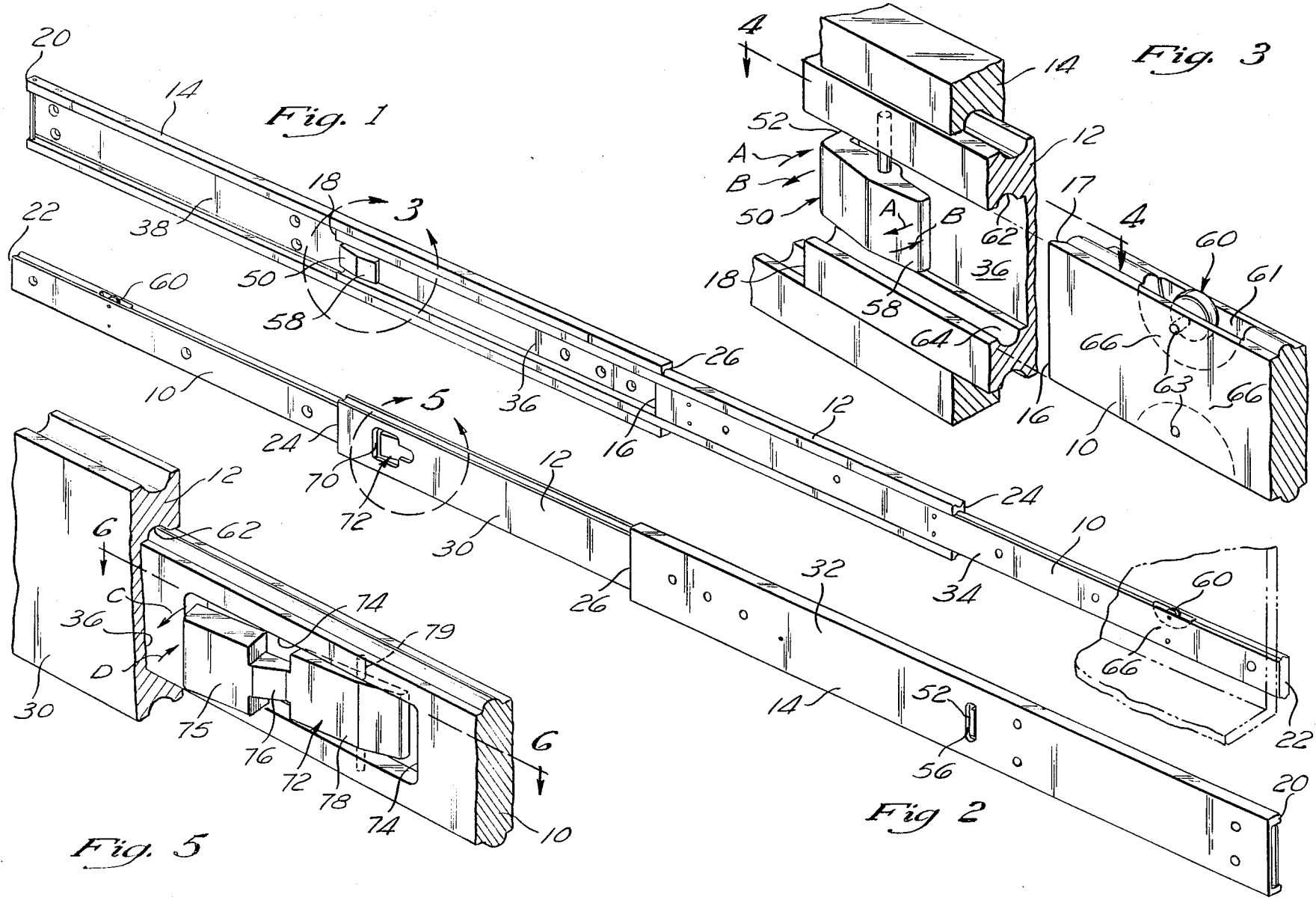
FIGS. 1 and 2 show opposite sides of a first preferred drawer slide assembly incorporating the first latching system which comprises the first and second latching mechanisms of the present invention in combination with the preferred drawer slide roller device of the present invention.
FIG. 3 is an exploded view showing the preferred first latching mechanism of the present invention and the preferred drawer,, slide roller device of the present invention.
FIG. 5 is an exploded view of the preferred second latching mechanism of the present invention.

Referring now to the drawings wherein the showings are for purposes of illustrating preferred embodiments of the invention and not for purposes of limiting its scope, the preferred first latching system of the present invention is shown in FIGS. 1, 2, 3, 4, 5, and 6. Such first latching system employs two separate latching mechanisms within a telescoping, multi-member drawer slide assembly.

This preferred embodiment, shown fully assembled in FIGS. 1 and 2, comprises three separate slide members telescopically slidably disposed within one another. Specifically, first slide member 10 is slidably disposable within the longitudinal channel 36 of second slide member 12 while second slide member 12 is slidably disposable within the longitudinal channel 38 of third slide member 14. Each of the slide members has a proximal end 16, 18, 20 and a distal end 22, 24, 26. Thus, when the drawer is in its fully closed position, the entire length of the first slide member 10 will reside within the longitudinal channel 36 of the second slide member 12 and the entire length of the second slide member 12 will reside within longitudinal channel 38 of third slide member 14. Conversely, when the drawer is pulled out to its fully extended position, the distal end 22 of first slide member 10 will extend a desired distance beyond the distal end 24 of second slide member 12 and the distal end 24 of second slide member 12 will extend a desired distance beyond the distal end 26 of third slide member 14.

The maximum distance to which the distal end of each slide member may travel out of its next adjacent slide member is governed by the inventive system of latching mechanisms disposed within the slide member In the first embodiment, a first latching system comprising two separate latching mechanisms is employed.

The first latching mechanism, specific aspects of which are shown in FIGS. 3 and 4, comprises a first latching member 50 pivotally mounted at the proximal end 18 of the second slide member 12. A pawl-like head 52 is formed on the distal end of the first latching member body 50. Also, the body of the latching member 50 is biased by spring 59 such that pawl-like head 52 will be continually urged in the direction of arrow A.

A corresponding first slit aperture 56 extends through third slide member 14. When the pawl-like head 52 of the first latch member body 50 comes into alignment with slit-like first aperture 56, the tension created by spring 59 will cause the pawl-like head 52 to snap into first aperture 56 thereby frictionally holding the second slide member 12 in a fixed position with respect to third slide member 14.

The first latching member 50 will remain in such "latched" position until the first latching member is pivotally manipulated in the direction of arrow B so as to lift pawl-like head 52 out of aperture 56, thereby releasing the second slide member 12 to be once again slidably movable within the longitudinal channel 38 of third slide member 14. Such pivotal manipulation of the first latching member body is achieved by the abutment of the proximal end 16 of the first slide member 10 into the distal-most end 58 of the first latch member body 50. Such abutment interaction will occur when the first slide member 10 is sufficiently proximally advanced into the longitudinal channel 36 of the second slide member 12 so as to form contact therewith The proximal end 16 of the first slide member 10 is provided with an angularly extending camming surface 17 shaped to correspond with, and cause pivotal movement of the distal-most portion 58 of the first latching member body 50. Thus, as the end 16 of first slide member 10 comes in contact with the distal portion 58 of the first latching member body 50, the angular camming surface 17 will exert pressure on spring 59 thereby lifting pawl-like head 52 out of aperture 56. Such disengagement of the first latching mechanism will once again permit free movement of the second slide member 12 within the longitudinal receiving channel 38 of the third slide member 14.

The second latching mechanism incorporated in the first preferred embodiment of the invention is specifically shown in FIGS. 5 and 6. Such second latching mechanism comprises a second latch member 72 which is pivotally mounted upon and disposable within a rectangular notch 74 formed within first slide member 10. The second latching member 72 is formed of a generally square engagement head 75, a narrowing mid-portion 76 and a rectangular basal portion 78. The basal portion 78 is pivotally connected to the inside of the mounting notch 74 by way of pivot pin 79.

The second latching member 72 is biased by spring 71 in the direction of arrow C. A corresponding, generally keyhole-shaped aperture 70 is formed in the flat outer surface 30 of the second slide member 12 The aperture 70 is sized, configured, and positioned such that when the engagement portion 75 of the second latch member 72 comes into alignment with aperture 70, the engagement portion 75 of the second latching member 72 will snap into the aperture 70 and will thereby frictionally engage the second slide member 12 so as to hold the first slide member 10 in fixed position relative to the second slide member 12.

Thus, the second latching member 72 interacts with the second aperture 70 to lock the outermost first slide member in its fully extended position after the drawer has been pulled out. When it is desired to close the drawer, the engagement portion 75 of the second latching member 72 is pressed inwardly using finger pressure. Such pressure on engagement member 75 will return the entire body of the second latching member 72 into its concealment notch 74 and will thereby free the first slide member 10 to be pushed proximally into the longitudinal channel of the second slide member 12. Similarly, when it is desired to detach the attendant drawer by fully removing the first slide member 10 from the longitudinal channel 36 of the second slide member 12, the user may depress the engagement member 75 into its concealment notch 74 and subsequently pull the first slide member 10 distally out of the longitudinal channel 36 of second slide member 12.

The slidable movement of the first slide member 10 within the longitudinal channel 36 of the second slide member 12 is facilitated by the provision of rollers 60 positioned along the upper and lower edges of the first slide member 10.

Each roller 60 is disposed within a recessed area or housing cavity 61 such that only a portion of the roller 60 extends above the upper (or below the lower) edge of the slide member 10.

Each roller 60 is rotatably mounted within its housing cavity 61 by way of a mounting pin 63. Such mounting pin 63 is passed through the hub of the wheel 60 and frictionally force fit into preformed apertures which extend through the side walls of the slide member 10.

In instances where the slide member 10 is formed of metals which may tend to deform or bend, the region 66 surrounding each aperture may be burnished or heat treated so as to increase the hardness of the metal surrounding the aperture 63, thereby preventing the pivot pin mounted roller 60 from becoming loose during use.

Also, the individual rollers 60 are preferably formed of a self-lubricating material which is sufficiently strong and wear-resistant to withstand many years of repetitive opening and closing of the drawer. In this preferred embodiment, the rollers 60 are formed of an aluminum-bronze alloy having the above-described desirable properties of strength, wear-resistance, and self-lubricity. While aluminum-bronze alloy is used in this preferred embodiment, many other metallic and non-metallic materials (e.g. nylon, teflon) may be used.

The shape of each wheel 60 is made to smoothly ride upon the corresponding upper and lower surfaces of the longitudinal receiving channel 36 of the second slide member 12. As shown, the surface of roller 60 is radiused to correspond with the upper 62 and lower 64 radial grooves which extend longitudinally within the receiving channel 36. Such arrangement provides for smooth, noise-free and relatively effortless movement of the first slide member 10 with respect to the second slide member 12.

Although the drawer slide roller device is shown here on the first slide member 10 only, it should be appreciated that such drawer slide roller device could be used on any drawer slide member which is formed and configured to accommodate the individual rollers without interfering with the functioning of the drawer slide assembly.

The second latching system of the invention comprises the alternative preferred embodiment shown in FIGS. 7 through 11. Such second latching system incorporates new third and fourth latching mechanisms in combination with the above-described first latching mechanism.

Figures 7, 8, 9, 11:
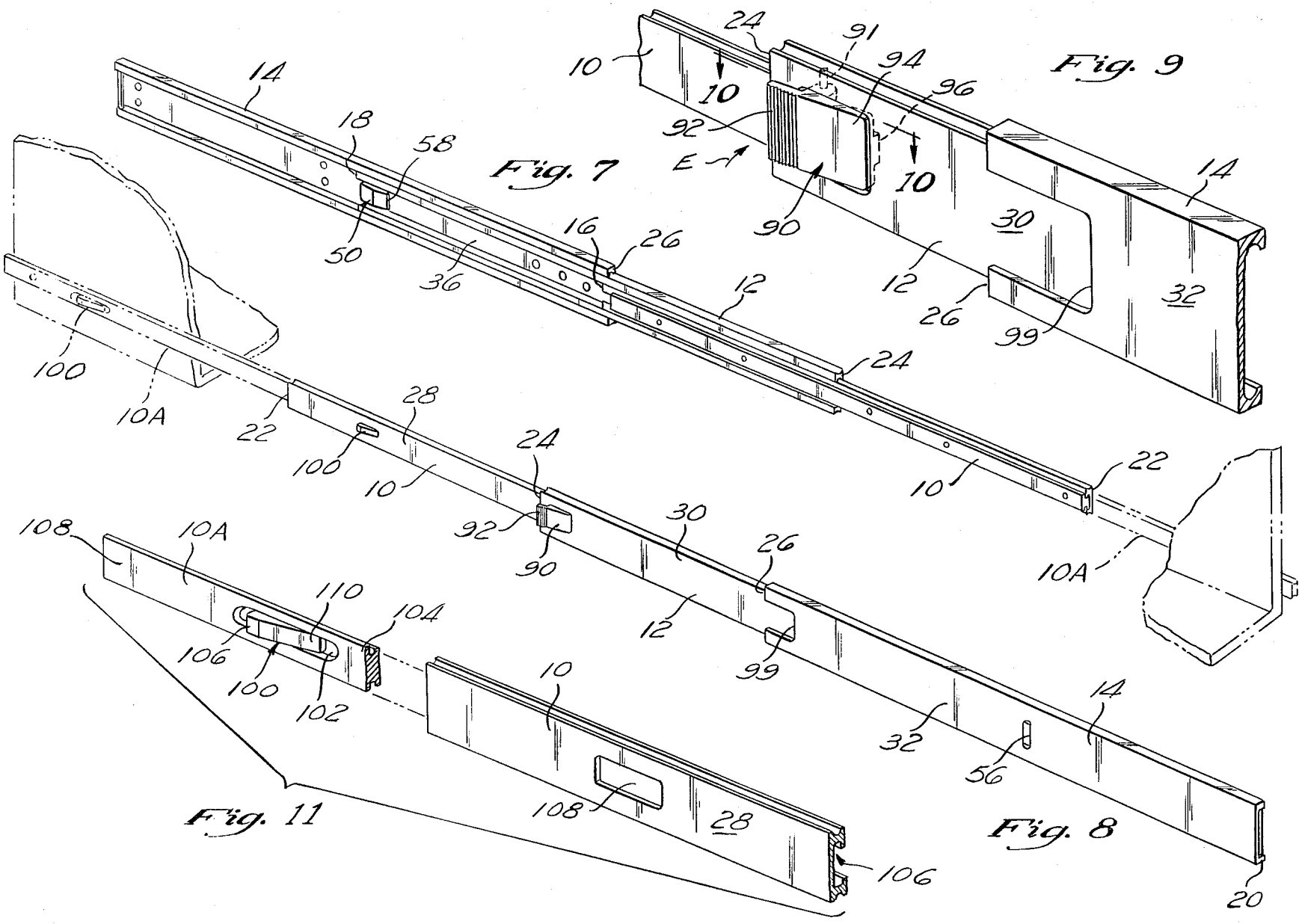
FIGS. 7 and 8 show opposite sides of an alternative preferred drawer slide assembly incorporating a second latching system which comprises the first, third, and fourth latching mechanisms of the present invention.
FIG. 9 is an exploded view showing the preferred third latching mechanism of the present invention.
FIG. 11 is an exploded view showing the preferred fourth latching mechanism of the present invention.

Specifically, FIGS. 7 and 8 show opposite sides of a second preferred drawer slide assembly wherein the first latching member body 50 is again positioned at the proximal end 18 of second slide member 12 while the corresponding slit aperture 56 extends through the inner wall 32 of the third slide member 14. Accordingly, such first latching member 50 will, as described above with respect to the first latching system, interact with slit aperture 56 to lock the second slide member 12 in fixed position with respect to the first slide member 14. Such fixed positioning will be maintained until such time as the proximal end 16 of the advancing first slide member 10 bumps against the distal end 58 of the first latching member body 50 so as to disengage the pawl-like head 52 of the first latching member from the corresponding slit aperture 56.

Additionally, in this second preferred embodiment, a third latching mechanism is employed for the purpose of locking the first slide member 10 in position with respect to the second slide member 12. Such third latching mechanism is shown in detail in FIGS. 9 and 10. Specifically, a third latching member 90 is positioned on the outer flat surface 30 of second slide member 12 near the distal end 24 thereof The third latch member 90 is provided with a grooved fingerpad 92 formed on one end thereof. The third latch member 90 is pivotally mounted to the second slide member 12 by pivot pin 91. The third latching member 90 is spring-biased as indicated by arrows E. A tongue-like projection 96 is formed on the proximal end 94 of the third latching member 90 A correspondingly shaped notch 98 is formed in the flat outer surface 28 of first slide member 10 such that, when said notch 98 comes into alignment with the tongue-like projection 96 of the spring-biased third latching member 90, the tongue-like projection 96 will snap into the corresponding notch 98 so as to frictionally engage the first slide member 10, thereby holding the first slide member 10 in fixed position relative to the second slide member 12.

Thus, when the drawer is pulled out, the third latching member 90 will snap into its corresponding notch 98 thereby locking the first slide member 10 in its optimally extended position relative to the second slide member 12. To return the drawer to its closed position, simple finger pressure is applied to the fingerpad portion 92 of the third latching member 90 thereby depressing spring 95 and pivotally retracting the pawl-like head 96 of the third latching member 90 from its corresponding aperture 98. Such will release the first slide member so that it may be slidably advanced into the corresponding longitudinal channel 36 of the second slide member 12.

A nesting notch 99 is formed in the distal end 26 of the third slide member 14.

The second preferred embodiment shown in FIGS. 7–11 may also include an additional slide member 10A. The additional slide member 10A does not normally slide in and out as the drawer is opened and closed but, instead, merely functions as a means for connecting the drawer to the first slide member 10. When, however, it is desired to fully disconnect and remove the drawer, the additional slide member 10A will be pulled out of the receiving track 106 formed within the first slide member 10.

The releasable connection of the additional slide member 10A within the receiving track 106 of the first slide member 10 is achieved by a fourth latching mechanism shown in detail in FIG. 11. Specifically the fourth latching mechanism comprises a fourth latching member 100 positioned within a recessed notch 102 near the proximal end 104 of the additional slide member 10A. The exposed surface of fourth latching member 100 is angled such that the distal-most portion 106 of the member 100 is raised a substantial distance beyond the flat surface 108 of the additional slide member 10A while the proximal end 110 of member 100 is contained fully within recessed notch 102. The fourth latching member 100 is, however, outwardly spring biased such that the raised distal portion 106 of the member 100 may be compressively forced into the retaining notch 102 of the additional slide member 10A such that the entire body of the fourth latching member 100 may become disposed within the recessed notch 102 so as to be flush or slightly recessed below the flat surface 108 of the additional slide member 10A.

The angular configuration of the fourth latching member 100 will permit the additional slide member 10A to be freely advanced into the receiving track 106 of the first slide member 10 to a point where the fourth latching member 100 will spring outwardly into aperture 108. The additional slide member 10A will thereafter be retractable from the receiving track 106 only when the raised distal portion 106 of fourth latching member 100 is volitionally compressed into its recessed notch 102 so that the entire body of the fourth latching member 100 will slide distally under the wall 28 of the first slide member 10.

OPERATION OF THE PREFERRED EMBODIMENTS i. Embodiment Incorporating the First Latching System and the Drawer Slide Roller Assembly The first preferred embodiment described herein generally comprises three separate telescoping slide members with the first slide member 10 being directly attached to either side of the drawer. As the drawer is initially pulled out, the first and second slide members will extend distally. Distal movement of the first slide member 10 within the elongate channel 36 of the second slide member 12 will be facilitated by rollers 60. When the second member 12 reaches its optimally extended point relative to third slide member 14, the first latching means 50 will engage its corresponding aperture 56 so as to lock the second slide member 12 in an optimally extended position relative to third slide member 14. Thereafter, as withdrawal of the drawer continues, the second latching member 72 will engage the corresponding second aperture 70 so as to lock the first slide member 10 in its optimally extended position relative to second slide member 12.

When the user wishes to return the drawer to its closed position, he must depress the engagement portion 75 of the second latching member 72 so as to remove the engagement portion 75 from frictional contact with aperture 70 thereby permitting the first slide member 10 to be advanced proximally into the receiving channel of second slide member 12. As the advancing proximal end 16 of the first slide member 10 contacts the distal portion 58 of the first latching member 50, the angular camming surface 17 at the proximal end 16 of the first slide member 10 will cause pivotal movement of the first latching member. Such pivotal movement will cause the pawl head 52 of the first latching member 50 to disengage from slit aperture 56 thereby allowing further proximal advancement of the second slide member 12 into the longitudinal channel 38 of third slide member 14. Thus, the drawer may be fully closed with the user having had manually disengaged only one latch member by simple finger pressure. The second latch member is automatically released by the advancing action of the slide members.

If the user wishes to detach and remove the attendant drawer when the drawer slide is in its extended position, the user may depress the engagement portion 75 of the second latching member 72 and subsequently pull the first slide member 10 distally out of the receiving channel 36 of the second slide member 12.

ii. Embodiment Incorporating the Second Latching System

The second latching system described herein functions somewhat differently than the first latching system. Specifically, the preferred drawer slide incorporating the second latching system generally comprises four slide members—first 10, second 12, and third 14 slide members as in the first drawer slide (above)—plus an additional slide member 10A by way of which the drawer is releasably attached to the drawer slide assembly. The additional slide member 10A is freely advanced into the receiving track 106 of first slide member 10 until the raised distal portion fourth latching member 100 snaps outwardly into aperture 108. Such will lock the drawer in its desired position on the end of first slide member 10. The fourth latching member 100 will not be compressed and disengaged until such time as the user wishes to completely detach the drawer from the attendant drawer slide apparatus.

In the second preferred embodiment, like the first preferred embodiment, the actual opening and closing of the drawer involves slidable movement of three slide members 10, 12, and 14. The first latching member 50 of the second preferred embodiment functions in the same manner as that of the first preferred embodiment. However, the third latching member 90 employed in this second latching system differs in operational aspects as well as structural configuration from the second latching member 72 described above with respect to the first latching system.

Specifically, as the drawer is pulled out the first slide member 10 extends out of the distal end 24 of the second slide member 12 to a point where the tongue-like projection 96 of the third latching member 90 will snap into notch 98 formed within the flat surface 28 of the first slide member 10. Thus, the third latching member 90/notch 98 will hold the first slide member 10 in its extended position relative to the second slide member 12 while the first latching member 50/notch 56 will hold the second slide member in its fully extended position relative to the third slide member 14 When closure of the drawer is desired the user may merely apply finger pressure to the fingerpad 92 of latching member 90 thereby withdrawing the tongue-like projection 96 from aperture 98 to permit the first slide member 10 to be advanced proximally into the longitudinal channel 36 of second slide member 12 to a point where the proximal end 16 of the first slide member 10 will engage or cam against the distal portion 58 of the first latch member 50 thereby releasing latch member 50 and permitting the drawer to be slid fully closed.

It should be appreciated that, although the structural and operational aspects of the invention have been described herein with reference to two preferred embodiments, various modifications and alterations may be made without departing from the spirit and scope of the invention. It is intended to include all such modifications and alterations within the scope of the following claims and the equivalents thereof. Having thusly described the invention,

What is claimed is:

1. A drawer slide assembly comprising:

at least first, second, and third slide members having proximal and distal longitudinal ends, said second and third slide members having internally formed elongated channels extending between said proximal and distal ends;

said second slide member being longitudinally slidably disposed within the elongated channel of the third slide member so as to be movable between an "unextended" position wherein the second slide member is fully disposed within the elongate channel of the third slide member and an "extended" position wherein a portion of the second slide member extends beyond the distal end of the third slide member;

said first slide member being longitudinally slidably disposed within the elongated channel of the second slide member so as to be movable between an "unextended" position wherein said first slide member is fully disposed within the elongated channel of the second slide member and an "extended" position wherein a portion of the first slide member extends beyond the distal end of the second slide member;

a first latching mechanism operative to releasably lock said second slide member in fixed longitudinal position relative to said third slide member, said first latching mechanism comprising:

a first latching member positioned on said second slide member;

a first aperture extending through said third slide member and alignable with at least a portion of said first latching member upon slidable movement of said second slide member relative to said first slide member;

said first latching member being spring biased to cause a portion of said first latching member to extend into said first aperture upon said slidable alignment thereof and to thereby hold said second slide member in fixed longitudinal position relative to said third slide member; and a second latching mechanism operative to releasably lock said first slide member in fixed longitudinal position relative to said second slide member, said second latching mechanism comprising:

a second latching member positioned on said first slide member;

a second aperture extending through said second slide member and alignable with at least a portion of said second latching member upon slidable movement of said first slide member within the elongated channel of said second slide member;

said second latching member being biased to urge at least said portion of said first latching member into said second aperture when said aperture becomes slidably aligned therewith and to thereby hold said first slide member in fixed longitudinal position relative to said second slide member.

2. The drawer slide assembly of claim 1 wherein said first latching member comprises a latching member body pivotally connected to said second slide member and having a pawl-like head formed thereon, said pawl-like head being sized, positioned, and configured to be urged into said first aperture when said first aperture comes into longitudinal alignment therewith.

3. The drawer slide assembly of claim 2 wherein said first aperture is specifically configured to permit said pawl-like head to reside freely yet snugly therewithin.

4. The drawer slide assembly of claim 1 wherein said first latching member is sized, configured, and positioned such that proximal advancement of said first slide member into the elongated channel of the second slide member will cause the distal end of said first slide member to bump into a portion of said first latching member, thereby causing the first latching member to be retracted from the first aperture, when so positioned, thus permitting further slidable movement of the first slide member within the elongated channel of said second slide member.

5. The drawer slide assembly of claim 4 wherein the distal end of the first slide member is provided with an angular camming surface configured to cam against and cause pivotal movement of said first latching member.

6. The drawer slide assembly of claim 1 wherein said first aperture is slit-like in configuration and extends transversely through said third slide member adjacent a point on the elongated channel which runs between the longitudinal ends of said third slide member.

7. The drawer slide assembly of claim 1 wherein the second latching member comprises an engagement head, a narrowing mid-portion, and a rectangular basal portion.

8. The drawer slide assembly of claim 7 wherein said second aperture is specifically configured to permit at least said engagement head to reside freely yet snugly therewithin.

9. The drawer slide assembly of claim 1 wherein the second latching member is pivotally mounted and wholly disposable within a recessed notch formed within the first latching member.

10. A drawer slide assembly comprising:

at least first, second, and third slide members having proximal and distal longitudinal ends, said second and third slide members having internally formed elongated- channels extending between said proximal and distal ends;

said second slide member being longitudinally slidably disposed within the elongated channel of the third slide member so as to be movable between an "unextended" position wherein the second slide member is fully disposed within the extended channel of the third slide member and an "extended" position wherein a portion of the second slide member extends beyond the distal end of the third slide member;

said first slide member being longitudinally slidably disposed within the elongated channel of the second slide member so as to be movable between an "unextended" position wherein said first slide member is fully disposed within the elongated channel of the second slide member and an "extended" position wherein a portion of the first slide member extends beyond the distal end of the second slide member;

a first latching mechanism operative to releasably lock said second slide member in fixed longitudinal position relative to said third slide member, said first latching mechanism comprising:

a first latching member positioned on said second slide member;

a first aperture extending through said third slide member and alignable with at least a portion of said first latching member upon slidable longitudinal movement of said second slide member relative to said first slide member;

said first latching member being spring biased to cause a portion of said first latching member to extend into said first aperture upon said slidable alignment thereof and to thereby hold said second slide member in fixed longitudinal position relative to said third slide member; and a second latching mechanism operative to releasably lock said first slide member in fixed longitudinal position relative to said second slide member, said second latching mechanism comprising:

a third latching member positioned on said first slide member;

a receiving notch formed within said second slide member and alignable with at least a portion of said third latching member upon slidable movement of said first slide member within the elongated channel of said second slide member;

said third latching member being biased to urge at least a portion thereof into said receiving notch when said receiving notch becomes slidably aligned therewith and to thereby hold said first slide member in fixed longitudinal position relative to said second slide member.

11. The drawer slide assembly of claim 10 wherein said third latching member comprises a latching member body pivotally connected to said second slide member and having a tongue-like projection formed thereon and extensible into the elongated channel formed within said second slide member, said tongue-like projection being sized, positioned, and configured to be urged into the receiving notch of said second slide member upon longitudinal alignment therewith.

12. The drawer slide assembly of claim 10 wherein said first latching member is sized, configured, and positioned such that proximal advancement of said first slide member into the elongated channel of the second slide member will cause the distal end of said first slide member to contact a portion of said first latching member, thereby causing the first latching member to be retracted from the first aperture when so positioned, thus permitting further slidable movement of the first slide member within the elongated channel of said second slide member.

13. The drawer slide assembly of claim 10 wherein the distal end of the first slide member is provided with an angular camming surface configured to cam against and cause pivotal movement of said first latching member.

14. The drawer slide assembly of claim 10 wherein said first aperture is slit-like in configuration and extends transversely through said third slide member adjacent a point on the elongated channel which runs between the longitudinal ends of said third slide member.

15. The drawer slide assembly of claim 10 wherein said first aperture is specifically configured to permit said pawl-like head to reside freely yet snugly therewithin.

16. The drawer slide assembly of claim 10 further comprising an additional slide member slidably disposed within an elongated receiving track formed longitudinally within the first slide member, said elongated receiving track being sized and configured to permit slidable movement of the additional slide member therewithin.

17. The drawer slide assembly of claim 16 further comprising a fourth latching mechanism for holding said additional slide member in fixed longitudinal position relative to said first slide member, said fourth latching mechanism comprising:

a fourth latching member positioned on said additional slide member;

a fourth aperture extending through said first slide member adjacent said receiving track, said fourth aperture being alignable with at least a portion of said fourth latching member upon slidable movement of said additional slide member within the receiving track of said first slide member;

said fourth latching member being compressible within the outer surfaces of the additional slide member to permit said additional side member to be fed into and slidably advanced within said receiving track; and said slide member being biased to urge at least a portion thereof through said fourth aperture when said fourth aperture becomes slidably aligned therewith and to thereby hold said additional slide member in fixed longitudinal position relative to said first slide member.

18. The drawer slide assembly of claim 17 wherein said fourth latching member is of tapered configuration so as to be proximally flush with the outer surfaces of said additional slide member and distally raised above the outer surfaces of the additional slide member such that the additional slide member may be fed proximally into the receiving track of the first slide member with the tapered body of the fourth latching member being compressibly passable into the receiving track absent manual compression thereof.

19. The drawer slide assembly of claim 18 wherein said fourth latching member, when positioned within said fourth aperture, is manually compressible so as to permit the additional slide member to be freely slidably withdrawn from the receiving track of the first slide member.

20. A drawer slide assembly comprising:

at least first and second slide members having proximal and distal longitudinal ends, upper and lower edges, and first and second lateral sides;

said second slide member having an internally formed elongate channel extending between the proximal and distal ends thereof;

said first slide member being longitudinally slidably disposed within the elongate channel of said first slide member so as to be alternately movable between an unextended position wherein the second slide member is substantially disposed within the elongate channel of the second slide member and an "extended" position wherein a portion of said first slide member extends out of and beyond the distal end of said second slide member;

said first slide member having at least one roller housing cavity formed therein, said cavity having an opening thereinto formed along an edge of said first slide member and first and second apertures respectively extending through the first and second lateral sides of said first slide member and into said hollow cavity, said first and second apertures being in direct alignment with one another;

at least one wheel-like roller having a central hub, said wheel-like roller being disposed in an operative position wherein the hub of said roller is positioned directly between said first and second apertures and a portion of said roller extends out the opening of said cavity and beyond the edge of said first slide member;

a pivot pin positioned through said first and second apertures and through the hub portion of said roller, said pivot pin thereby effecting rotatable affixation of said roller in said operative position; and wherein the first slide member is burnished about said first and second apertures to deter deformation of said first slide member in regions surrounding said first and second apertures.

21. The drawer assembly of claim 20 wherein said at least one wheel-like roller is formed of an aluminum bronze alloy.

22. The drawer slide assembly of claim 20 wherein said at least one wheel-like roller is formed of plastic.

23. The drawer slide assembly of claim 20 wherein:

the elongate channel formed within said second slide member incorporates at least one radial groove extending longitudinally therewithin;

wherein said at least one wheel-like roller is substantially analogous in configuration to said at least one radial groove; and wherein said at least one wheel-like roller is positioned in rolling contact with said radial groove as said drawer slide is moved between its "unextended" and "extended" positions.

24. The drawer slide assembly of claim 20 wherein a plurality of said roller housing notches and a plurality of said rollers are positioned along each of said upper and lower edges of said first slide member.

25. A drawer slide assembly having at least first and second metal slide members, each of said first and second slide members having proximal and distal ends, upper and lower edges, and first and second lateral sides, said second slide member having an elongate channel formed and extending longitudinally therewithin and said first slide member being longitudinally slidably disposed within said elongate channel, at least one roller housing cavity formed in said first slide member, said cavity having an opening thereinto formed along an edge of said first slide member and first and second apertures respectively extending through the first and second lateral sides of said first slide member and into said cavity, said first and second apertures being in direct alignment with one another and at least one wheel-like roller having a central hub, said wheel-like roller being partially disposed in an operative position wherein the hub of said roller is positioned directly between said first and second apertures and a portion of said roller extends out of the opening of said cavity and beyond the edge of said first slid member and a pivot pin positioned through said first and second apertures and through the hub portion of said roller, said pivot pin thereby effecting rotatable affixation of said roller in said operative position; the improvement comprising:

burnishing said first slide member about said first and second apertures to deter deformation of said first slide member in regions surrounding said first and second apertures.

26. The drawer slide assembly of claim 25 wherein said at least one wheel-like roller is formed of an aluminum bronze alloy.

27. The drawer assembly of claim 25 wherein said at least one wheel-like roller is formed of plastic.

28. The drawer slide assembly of claim 25 wherein:

the elongate channel formed within said second slide member incorporates at least one radial groove extending longitudinally therewithin; and wherein said at least one wheel-like roller is substantially analogous in configuration to said at least one radial groove; and wherein said at least one wheel-like roller is positioned in rolling contact with said radial groove as said drawer slide is moved between its "unextended" and "extended" positions.

29. The drawer slide assembly of claim 25 wherein a plurality of said roller housing notches and a plurality of said rollers are positioned along each of said upper and lower edges of said first slide member.

* * * * *